United States Patent [19]

Wiedemann

[11] Patent Number: 4,855,569

[45] Date of Patent: Aug. 8, 1989

[54] WATER HEATER FOR PREFORMED SPAS AND BAPTISMAL POOLS

[76] Inventor: Martin F. Wiedemann, c/o Wiedemann Industries, Inc., Progress Industrial Park, P.O. Box 677, Muscatine, Iowa 52761

[21] Appl. No.: 156,596

[22] Filed: Feb. 17, 1988

[51] Int. Cl.[4] ..... H05B 1/02; F24H 1/10; F04B 21/00; E04H 3/20

[52] U.S. Cl. ..... 219/306; 4/493; 68/16; 219/297; 219/308

[58] Field of Search ..... 4/493, 509, 545; 219/296–309; 68/16

[56] References Cited

U.S. PATENT DOCUMENTS

| | | | |
|---|---|---|---|
| 2,377,027 | 5/1945 | Morgan et al. | 219/306 |
| 2,419,273 | 4/1947 | Marquette | 219/296 X |
| 2,914,935 | 12/1959 | Samsel | 68/16 |
| 4,594,500 | 6/1986 | Wright | 219/308 X |

FOREIGN PATENT DOCUMENTS

| | | | |
|---|---|---|---|
| 1307048 | 9/1962 | France | 219/306 |

*Primary Examiner*—Anthony Bartis

*Attorney, Agent, or Firm*—Simmons, Perrine, Albright & Ellwood

[57] ABSTRACT

An electric water heater for preformed spas and baptismal pools includes an elongated horizontally disposed tubular heat exchanger having a water inlet in a first end wall and a water outlet adjacent the opposite second end wall and defining a water flow path provided with an electric heating element extending longitudinally therethrough from the first end wall for heating the water. A pump having an inlet communicating with the flow path through the second end wall has a first outlet directing some of the water from the flow path to the heat exchanger outlet in a direction away from the heat exchanger to provide a venturi action causing additional water to flow directly out the heat exchanger outlet without passing through the pump and a second outlet which directs a small counterflow of water into the heat exchanger towards the first end wall to break up and keep in circulation scale and sediment. The second pump outlet is arranged to drain water from the pump when the heat exchanger is drained through the inlet in the first end wall.

3 Claims, 2 Drawing Sheets

WATER HEATER FOR PREFORMED SPAS AND BAPTISMAL POOLS

BACKGROUND OF THE INVENTION

Preformed spas and baptismal pools normally include some means for heating the water. Typically the water in the pool is circulated by a pump through a small heater mounted adjacent one wall of the pool, the heater also including means to adjust the water temperature. Usually the heating means is electrical and includes a heating element mounted within a heat exchanger through which water from the pool flows. Over a period of use, especially with hard water, scale and sediment build-up on the interior of the heat exchanger surrounding the heating element, tending to insulate the heating element, to decrease its efficiency, and finally to cause it to overheat and burn out. So the chief aim of the present invention is to minimize as far as possible the build-up of such scale and sediment within heaters of the kind concerned and thus prolong the life of their heating elements.

SUMMARY OF THE INVENTION

Esentially the aim of the invention is accomplished by providing the pump which circulates the water through the heat exchanger with a second, smaller outlet by which water is directed into the heat exchanger in a direction opposite to that of the main flow of water through the heat exchanger. The resulting back or counterflow reduces the build-up of scale and sediment by keeping them in circulation through the heat exchanger and the pool. The second outlet of the pump is disposed so that it also functions as a drain for the pump when water is emptied from the pool and the heat exchanger during colder days of the year since many such pools are out-of-doors. The heat exchanger itself is designed to be self-draining under those conditions and advantage is taken of that by simply having the pump drain into the heat exchanger. Other features and advantages of the invention will become apparent from the drawings and the more detailed description which follows.

DETAILED DESCRIPTION OF THE PREFERRED EMBODIMENT

Figure 1:
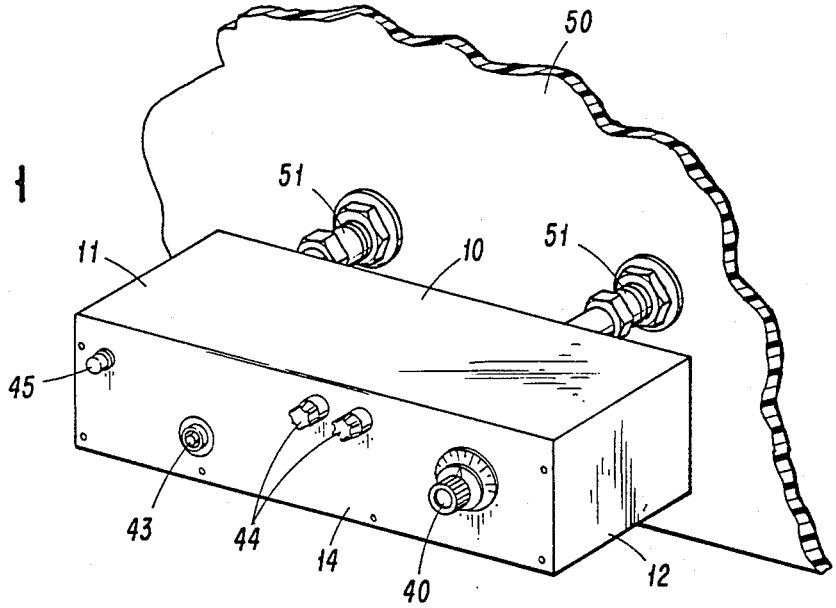
FIG. 1 is a perspective view of a water heater according to the invention shown connected into the wall of a baptismal pool, for instance.

As shown in the drawings the water heater includes an overall housing 10, having top and bottom walls 11, side walls 12, a front wall 13 and a rear wall 14. The heat exchanger itself, generally designated at 15, includes a pair of plate end walls 16 and 17 which close the ends of an elongated cylindrical tube 18, the bottoms of the end wall plates 16 and 17 being flanged in order to attach and support the heat exchanger 15 to and above the housing bottom wall 11. Adjacent the end wall 16 a water inlet pipe 19 enters the lowermost portion of the tube 18 while adjacent the end wall 17 a water outlet pipe 20 leaves the uppermost portion of the tube 18, both pipes 19 and 20 being disposed at right angles to the axis of the tube 18. To the end wall 16 is mounted the base 21 of a Calrod heater 22 whose heating element 23 extends axially into the tube 18 through the end wall 16, the heating element 23 reaching nearly to the end wall 17 before doubling back upon itself. By varying the length, watt density, or number of the heating element 23 the heater can accommodate pools of different sizes.

Figure 3:
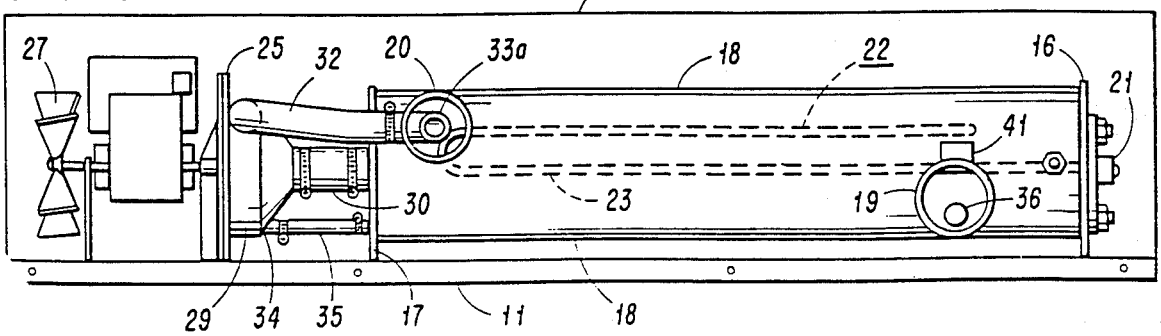
FIG. 3 is a rear elevational view of the heater of FIG. 2 with the top side and front walls of the housing removed.

A centrifugal pump 25, driven by an electric motor 26 which is cooled by a fan 27, is disposed adjacent the end wall 17 and supported on the housing bottom wall 11 by an upstanding plate 28. The center intake of the pump volute 29 communicates with the interior of the heat exchanger 15 through the middle of the end wall 17 by means of a flexible hose 30. The primary output from the heat pump 25 is taken off at 31 from the periphery of the volute 29 and connected by a hose 32 to an L-shaped pipe 33 passing through the wall of the outlet pipe 20 and thence turning downstream to provide a portion **33*a* spacedly surrounded by the pipe 20. A secondary, smaller output from the pump 25 is taken off at 34 (see FIG. 3) from the lowermost periphery of the pump volute 29 and connected by a hose 35 into the lowermost portion of the heat exchanger 15 through its end wall 17**.

Figure 2:
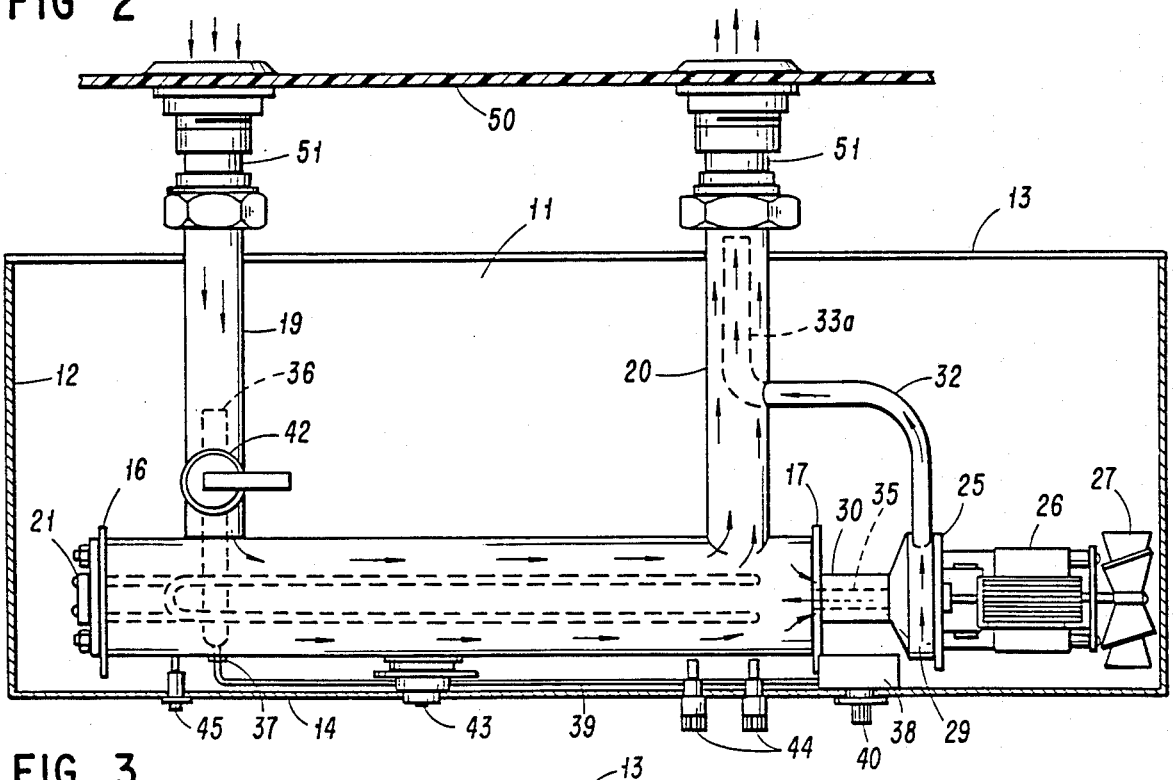
FIG. 2 is a plan view of the heater of FIG. 1 with the top of its housing omitted in order to illustrate the heat exchanger and other parts.

A tubular housing 36 is concentrically disposed within the inlet pipe 19 and extends across and through the tube 18. The housing 36 then opens to receive the sensor bulb 37 of a thermostat 38 mounted on the housing rear wall 14 and connected at 39 to the bulb 37 (see FIG. 2). The setting of the thermostat 38 is adjusted by a dial 40 on the outer face of the wall 14. The top of the inlet pipe 19 is provided with a tubular seat 41, internally threaded, which opens into the pipe 19 and receives an adjustable water pressure switch 42. On the rear housing wall 14 are also mounted a thermal safety switch 43 in contact with the wall of the heat exchanger tube 18, a pair of fuses 44 for the pump motor 26, and an indicator lamp 45.

Figure 4:
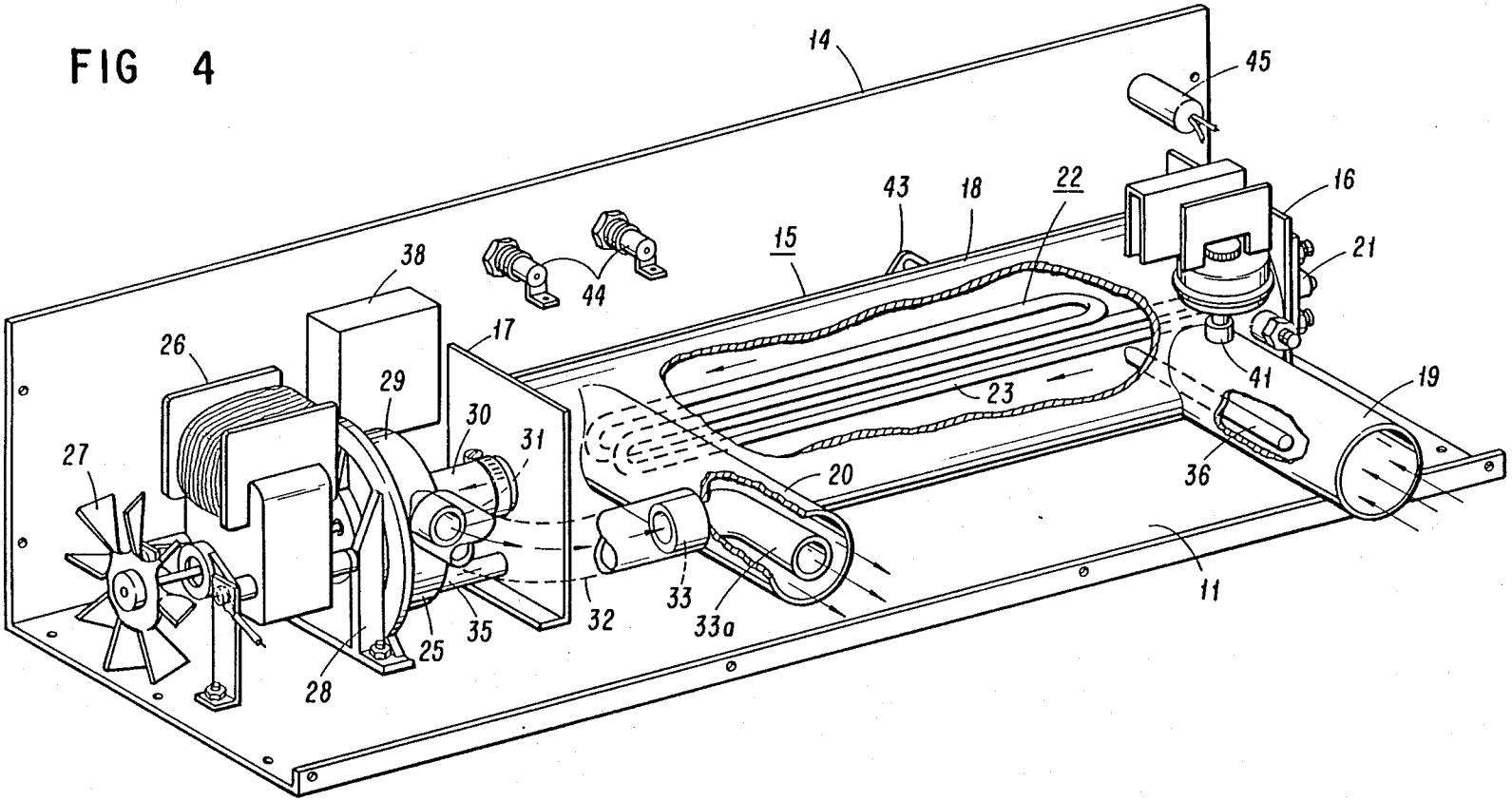
FIG. 4 is a perspective view of the heater, also with the top, side and front housing walls removed, and a portion of the heat exchanger itself sectioned to illustrate its interior.
Figure 1:
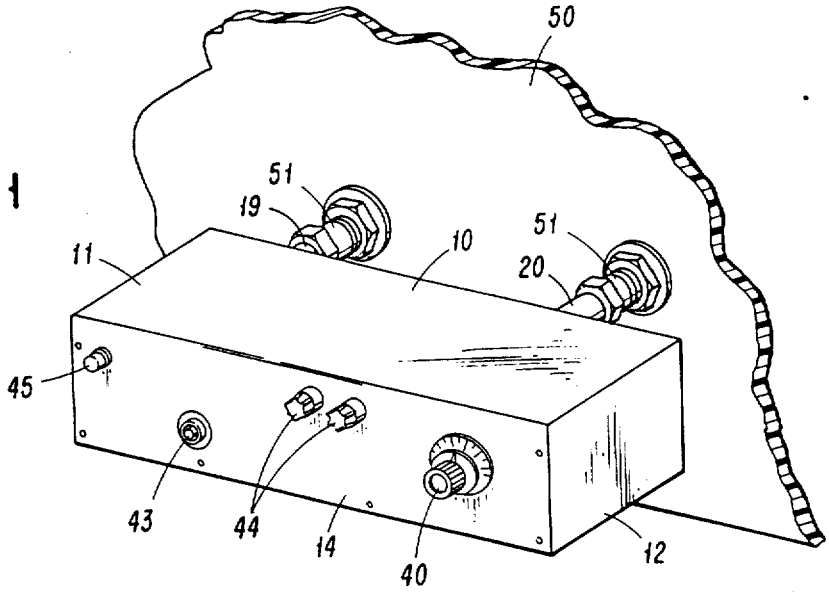
Figure 2:
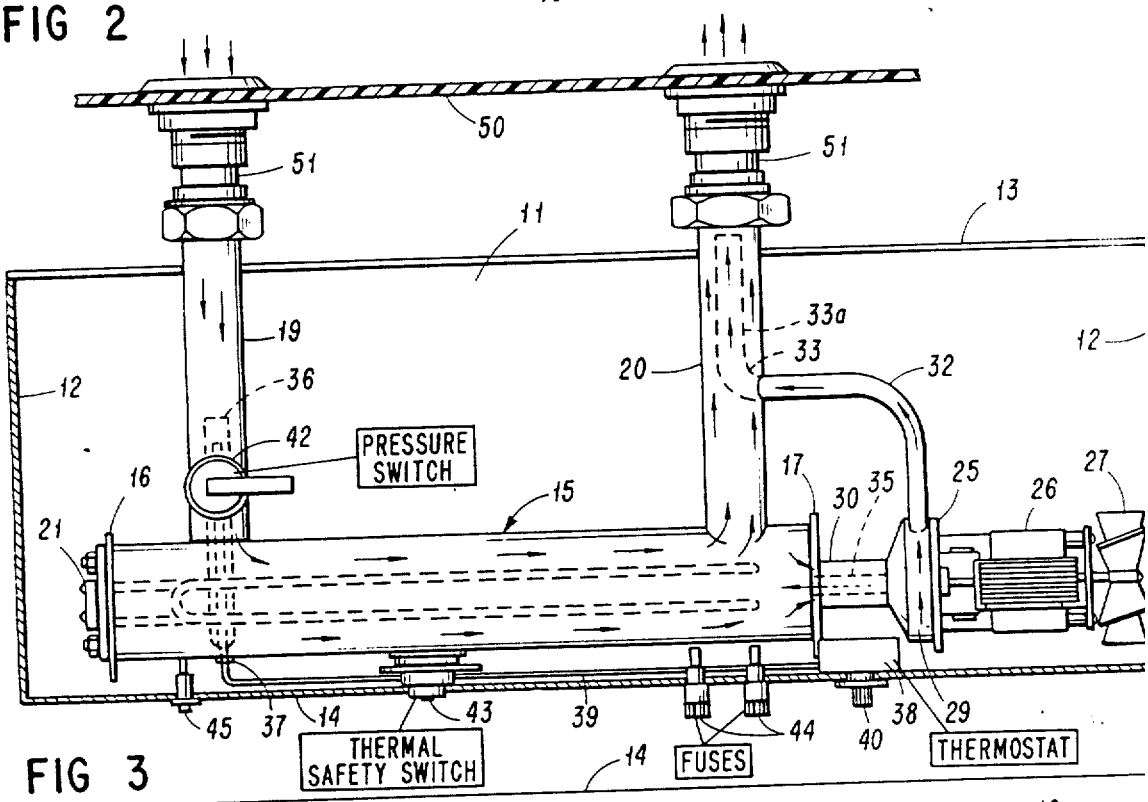
Figure 3:
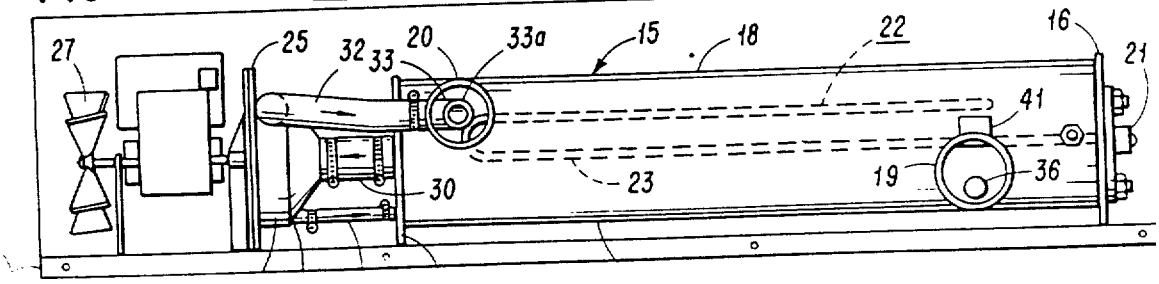
Figure 4:
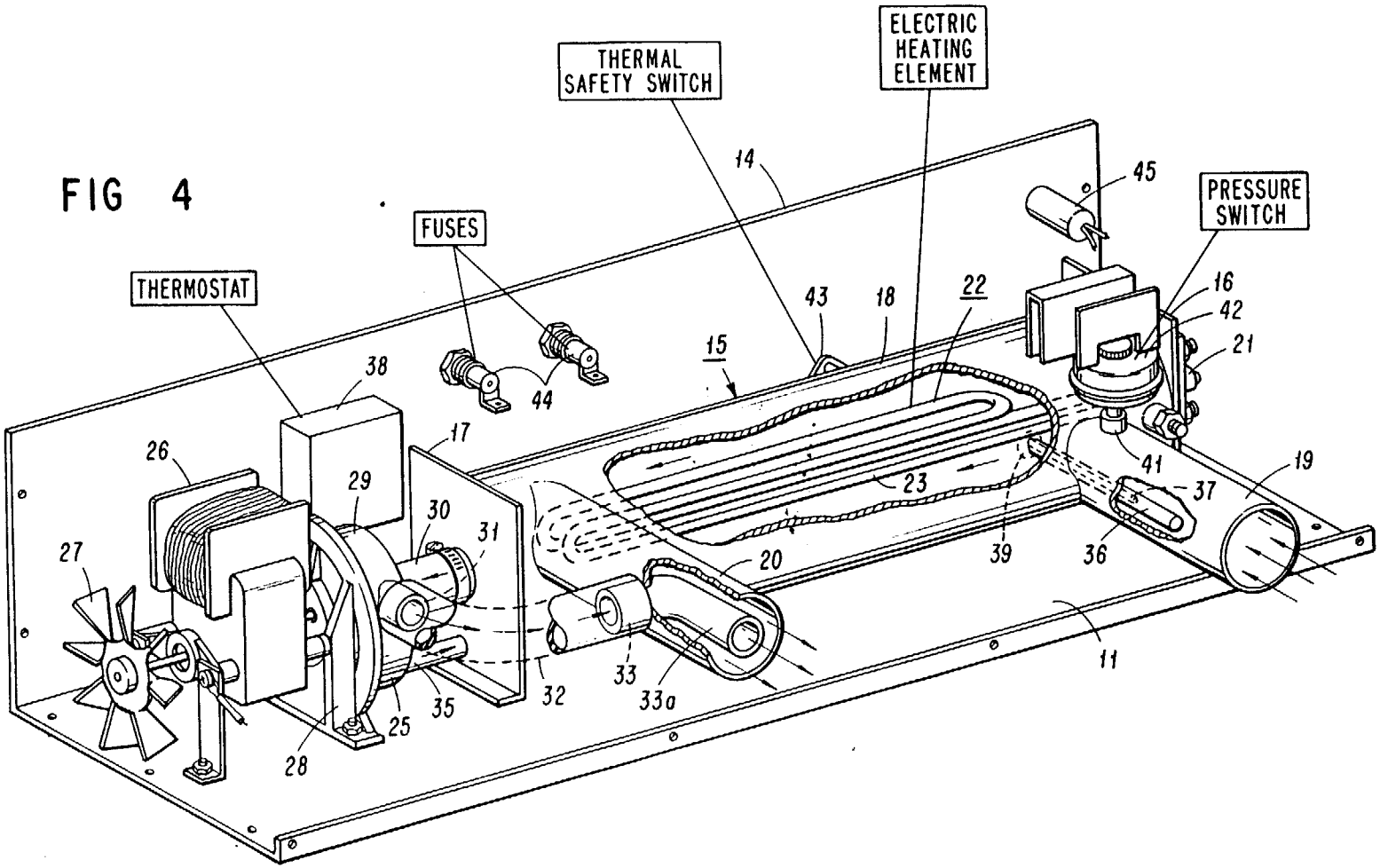

The heater is mounted to an upright wall 50 of the pool so that the heat exchanger 15 is substantially horizontal, the inlet and outlet pipes 19 and 20 of the latter being connected through the pool wall 50 by appropriate fittings 51. When the water in the pool reaches the level of the inlet pipe 19 water begins to fill the heat exchanger 15, the air within the latter being gradually exhausted through the outlet pipe 20 since the latter is taken off the top and the inlet pipe 19 off the bottom of the heat exchanger 15. If the water in the pool has reached a safe predetermined level above the heating element 23, as set by the water pressure switch 42, and if the temperature of the water is below that desired, as set on the dial 40 of the thermostat 38 and sensed by the bulb 37 in the inlet pipe 19, a circuit to the CALROD heater 22 and the pump motor 26 is completed through the pressure switch 42 and the thermal safety switch 43, the lamp 45 then lighting to indicate that the system is in operation. Water then flows through the heat exchanger 15 into the pump 25 through the hose 30 and then out through hose 32 and pipe 33 into the outlet pipe 20, as shown by the arrows in FIGS. 2 and 4. The inner portion 33a of the pipe 33 provides a venturi action in the outlet pipe 20 in order to effect a more rapid flow of water through the heat exchanger 15 by directing some of the water to flow directly out the pipe 20 without passing through the pump 25. At the same time the small, secondary outlet 34 from the pump volute 29 directs a counterflow jet of water into the heat exchanger 15 through the hose 35 to break up and keep in suspension hardened scale and sediment in the water so that the same are kept in circulation through the pool and the heat exchanger 15 rather than deposited in the latter.

When the water reaches the desired temperature, the thermostat 38 shuts-off the Calrod heater 22 and the pump 25. If the water level in the pool should drop below the foregoing predetermined safe level, owing to a leak or intentional drainage of the pool, the water pressure switch 42 will open the circuit to the Calrod heater 22 and pump 25, thus shutting down the entire system. If the pump 25 or its motor 26 should fail, should the thermostat 38 or the pressure switch 42 become inoperative, and/or should the water level drop below the inlet tube 19, the thermo safety switch 43 will shut off the Calrod heater 22, should that still be energized for some reason under the circumstances, in order to prevent overheating of the heating exchanger 15. The electrical circuitry involved in the foregoing is quite conventional and well within the skill of the art to provide. Since it plays no part in the present invention it is not necessary to describe further. When the pool is intentionally drained during colder weather, as the water level drops below the outlet pipe 20, all the water will drain from the pump 25 through the hose 35 into the exchanger 15 and from the latter through the inlet pipe 19 owing to the low level of the secondary pump output 34 and the inlet pipe 19. In short, the operation of the system is entirely automatic throughout.

Though the present invention has been described in terms of a particular embodiment, being the best mode known of carrying out the invention, it is not limited to that embodiment alone. Instead the following claims are to be read as encompassing all adaptations and modifications of the invention falling within its spirit and scope.

I claim:

1. In a heater for water including a hollow heat exchanger defining a water flow path therethrough, said heat exchanger having a pair of opposite first and second end walls and an elongated tubular wall interconnecting said end walls, the heat exchanger being adapted for operating disposition wherein its tubular wall extends in a generally horizontal direction, a water inlet to the heat exchanger disposed adjacent the first end wall and located effective to allow substantially all water in the heat exchanger to drain therefrom through said inlet when the heat exchanger is disposed as aforesaid and the inlet is unsupplied with water, a water outlet from the heat exchanger disposed adjacent the second end wall and located effective to allow substantially all air in the heat exchanger to be expelled therefrom through said outlet when the heat exchanger is disposed as aforesaid and water is supplied to said inlet, electrical means within the housing for heating water, the heating means being mounted adjacent the first end wall and extending longitudinally of the heat exchanger towards the second end wall, and a pump disposed adjacent the exterior of the second end wall, the pump having a water inlet communicating with the interior of the heat exchanger through the second end wall and a first water outlet communicating with the heat exchanger outlet in a direction away from the heat exchanger for circulating water through the heat exchanger, the improvement wherein the pump includes a smaller second water outlet communicating with the interior of the heat exchanger through the second end wall and effective to direct a counterflow of water into the heat exchanger towards the first end wall to reduce the build-up of scale and sediment in the heat exchanger by keeping such scale and sediment in suspension in the water and in circulation.

2. The heater of claim 1 wherein the second pump outlet is disposed effective to allow substantially all water in the pump to drain therefrom through said second pump outlet into the heat exchanger when disposed as aforesaid and the heat exchanger inlet is unsupplied with water.

3. The heater of claim 2 including a first conduit extending from the heat exchanger outlet and a second conduit extending from the first pump outlet and into the first conduit, the second conduit having a portion within and spacedly surrounded by the first conduit and disposed effective to direct water in a direction away from the heat exchanger outlet.

* * * * *

UNITED STATES PATENT AND TRADEMARK OFFICE

CERTIFICATE OF CORRECTION

PATENT NO. : 4,855,569

DATED : August 8, 1989

INVENTOR(S) : Martin L. Wiedemann

It is certified that error appears in the above-identified patent and that said Letters Patent is hereby corrected as shown below:

Corrected drawings are substituted for the uncorrected drawings erroneously published. The cover sheet is corrected to reflect the substitution of the corrected drawings.

Signed and Sealed this

Fourteenth Day of August, 1990

*Attest:*

HARRY F. MANBECK, JR.

*Attesting Officer*

*Commissioner of Patents and Trademarks*

United States Patent [19]

Wiedemann

[11] Patent Number: 4,855,569

[45] Date of Patent: Aug. 8, 1989

[54] WATER HEATER FOR PREFORMED SPAS AND BAPTISMAL POOLS

[76] Inventor: Martin F. Wiedemann, c/o Wiedemann Industries, Inc., Progress Industrial Park, P.O. Box 677, Muscatine, Iowa 52761

[21] Appl. No.: 156,596

[22] Filed: Feb. 17, 1988

[51] Int. Cl.[4] ..... H05B 1/02; F24H 1/10; F04B 21/00; E04H 3/20

[52] U.S. Cl. ..... 219/306; 4/493; 68/16; 219/297; 219/308

[58] Field of Search ..... 4/493, 509, 545; 219/296–309; 68/16

[56] References Cited

U.S. PATENT DOCUMENTS

| | | | |
|---|---|---|---|
| 2,377,027 | 5/1945 | Morgan et al. | 219/306 |
| 2,419,273 | 4/1947 | Marquette | 219/296 X |
| 2,914,935 | 12/1959 | Samsel | 68/16 |
| 4,594,500 | 6/1986 | Wright | 219/308 X |

FOREIGN PATENT DOCUMENTS

| | | | |
|---|---|---|---|
| 1307048 | 9/1962 | France | 219/306 |

*Primary Examiner*—Anthony Bartis
*Attorney, Agent, or Firm*—Simmons, Perrine, Albright & Ellwood

[57] ABSTRACT

An electric water heater for preformed spas and baptismal pools includes an elongated horizontally disposed tubular heat exchanger having a water inlet in a first end wall and a water outlet adjacent the opposite second end wall and defining a water flow path provided with an electric heating element extending longitudinally therethrough from the first end wall for heating the water. A pump having an inlet communicating with the flow path through the second end wall has a first outlet directing some of the water from the flow path to the heat exchanger outlet in a direction away from the heat exchanger to provide a venturi action causing additional water to flow directly out the heat exchanger outlet without passing through the pump and a second outlet which directs a small counterflow of water into the heat exchanger towards the first end wall to break up and keep in circulation scale and sediment. The second pump outlet is arranged to drain water from the pump when the heat exchanger is drained through the inlet in the first end wall.

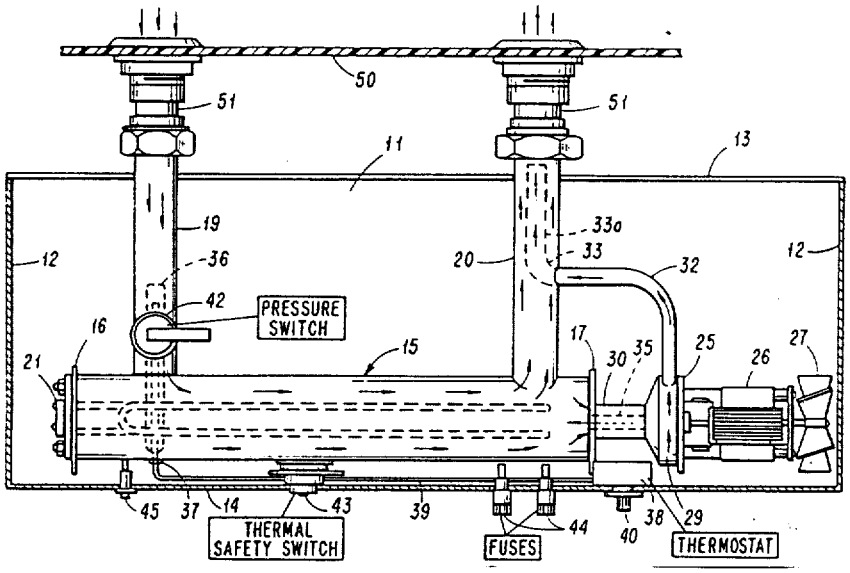

3 Claims, 2 Drawing Sheets